US008403057B2

(12) United States Patent
Rodgers et al.

(10) Patent No.: US 8,403,057 B2
(45) Date of Patent: Mar. 26, 2013

(54) WELLHEAD CONNECTION

(75) Inventors: Doyle W. Rodgers, Longview, TX (US); Keith David Farquharson, Edmonton (CA)

(73) Assignee: Stream-Flo Industries Ltd., Edmonton (CA)

( * ) Notice: Subject to any disclaimer, the term of this patent is extended or adjusted under 35 U.S.C. 154(b) by 309 days.

(21) Appl. No.: 12/858,333

(22) Filed: Aug. 17, 2010

(65) Prior Publication Data

US 2011/0036589 A1 Feb. 17, 2011

Related U.S. Application Data

(60) Provisional application No. 61/234,570, filed on Aug. 17, 2009.

(51) Int. Cl.
*E21B 23/00* (2006.01)
*E21B 19/00* (2006.01)

(52) U.S. Cl. ..... 166/360; 166/338; 166/368; 166/378; 166/85.1; 166/75.13; 285/123.1

(58) Field of Classification Search ..... 166/360, 166/338, 339, 341, 368, 378–380, 85.1, 75.13; 285/123.1
See application file for complete search history.

(56) References Cited

U.S. PATENT DOCUMENTS

| | | | | |
|---|---|---|---|---|
| 2,150,887 | A * | 3/1939 | Mueller et al. | 166/379 |
| 3,155,401 | A * | 11/1964 | Musolf | 285/18 |
| 3,902,743 | A | 9/1975 | Martin | |
| 4,239,266 | A | 12/1980 | Mynhier | |
| 4,304,424 | A | 12/1981 | Hansen | |
| 4,453,745 | A | 6/1984 | Nelson | |
| 4,526,406 | A | 7/1985 | Nelson | |
| 4,552,213 | A * | 11/1985 | Boyd et al. | 166/88.4 |
| 4,651,830 | A * | 3/1987 | Crotwell | 166/338 |
| 4,936,382 | A | 6/1990 | Thomas | |
| 5,039,140 | A | 8/1991 | Szymezak | |
| 5,149,143 | A * | 9/1992 | Howell | 285/18 |
| 5,299,644 | A | 4/1994 | Eckert | |
| 5,309,991 | A | 5/1994 | Watkins | |
| 5,332,043 | A | 7/1994 | Ferguson | |
| 5,333,911 | A * | 8/1994 | Watkins | 285/18 |
| 5,433,274 | A | 7/1995 | Graff | |
| 5,611,398 | A * | 3/1997 | Duhn et al. | 166/75.11 |

(Continued)

FOREIGN PATENT DOCUMENTS

CA 2643800 5/2009

OTHER PUBLICATIONS

International Preliminary Report on Patentability, dated Feb. 21, 2012, corresponding to International Application No. PCT/CA2010/001266 (filed Aug. 17, 2010), parent of the present application, 6 pp.

*Primary Examiner* — Matthew Buck
(74) *Attorney, Agent, or Firm* — Lathrop & Gage LLP

(57) ABSTRACT

A wellhead connection including first and second housings with the first housing partly within the second housing to form an annulus. The housings form a seal to a cylindrical inner bore when connected together. The first housing has a circumferential groove formed in its outer periphery. A radially expandable and contractable latch ring formed from latch ring segments is located in the annulus adjacent the circumferential groove. Radial actuators extend through the second housing to the latch ring segments to move the latch ring segments between a contracted position with the latch ring in contact with the circumferential groove, and an expanded position, with the latch ring out of contact with the circumferential groove. The upper and lower housings are adapted to lock the latch ring in the contracted position by applying a downward force on the latch rings, or by tightening the bottom connector to a wellhead member.

23 Claims, 3 Drawing Sheets

U.S. PATENT DOCUMENTS

| | | | | |
|---|---|---|---|---|
| 5,951,066 | A * | 9/1999 | Lane et al. | 285/364 |
| 6,199,914 | B1 * | 3/2001 | Duhn | 285/123.1 |
| 6,561,521 | B2 | 5/2003 | Janoff | |
| 6,712,147 | B2 * | 3/2004 | Dallas | 166/379 |
| 6,834,718 | B2 * | 12/2004 | Webster | 166/89.3 |
| 7,322,407 | B2 * | 1/2008 | Duhn et al. | 166/75.14 |
| 7,344,162 | B2 * | 3/2008 | Van Bilderbeek | 285/95 |
| 7,416,020 | B2 * | 8/2008 | Duhn et al. | 166/75.13 |
| 7,484,776 | B2 * | 2/2009 | Dallas et al. | 285/354 |
| 7,493,944 | B2 * | 2/2009 | Duhn et al. | 166/75.13 |
| 7,520,322 | B2 * | 4/2009 | Duhn et al. | 166/75.13 |
| 7,654,585 | B2 * | 2/2010 | Dallas et al. | 285/354 |
| 7,726,393 | B2 * | 6/2010 | Duhn et al. | 166/75.13 |
| 7,775,288 | B2 * | 8/2010 | Hickie | 166/379 |
| 7,909,105 | B2 * | 3/2011 | Borak et al. | 166/379 |
| 7,922,216 | B2 * | 4/2011 | Dallas et al. | 285/354 |
| 8,205,916 | B2 * | 6/2012 | Dallas et al. | 285/354 |
| 2007/0107910 | A1 | 5/2007 | McGuire | |
| 2009/0266558 | A1 | 10/2009 | Farquharson | |

* cited by examiner

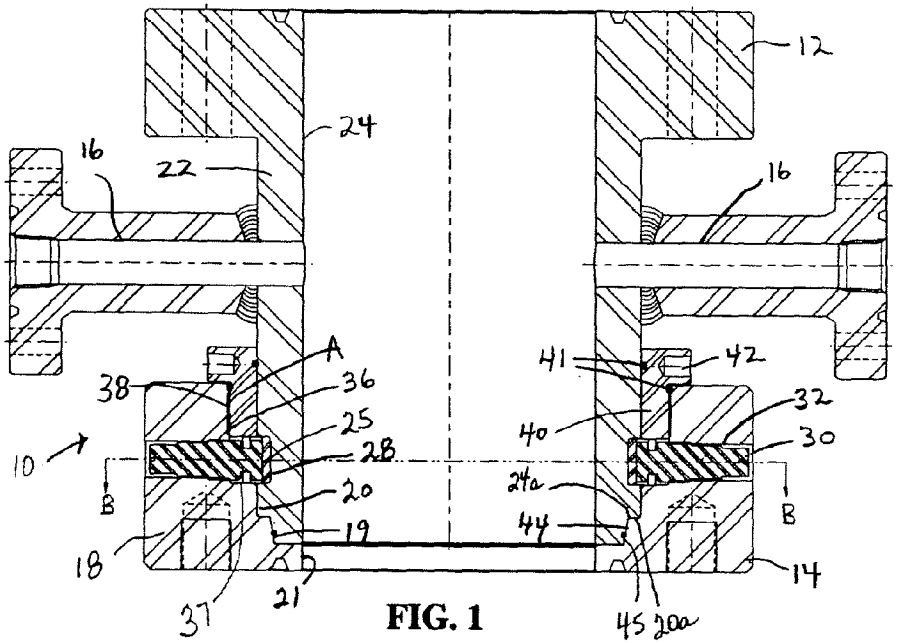
FIG. 1
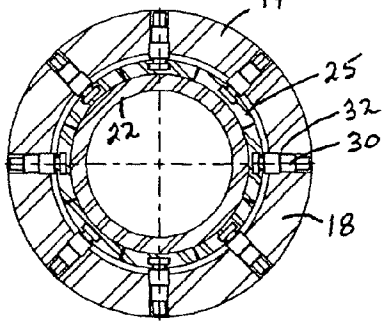
FIG. 3
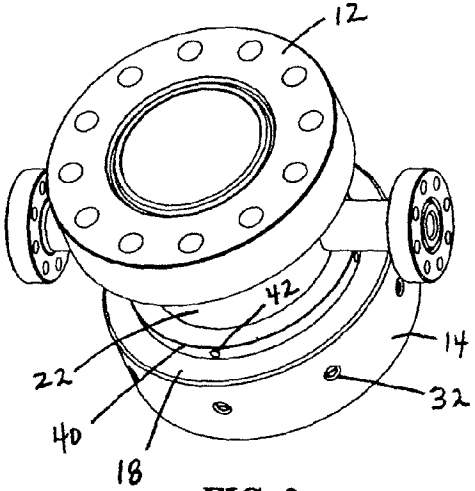
FIG. 2
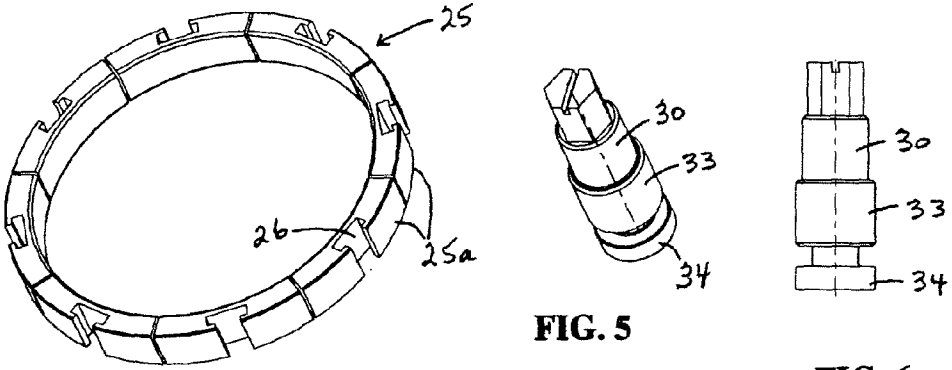
FIG. 4
FIG. 5
FIG. 6

WELLHEAD CONNECTION

CROSS-REFERENCE TO RELATED APPLICATION

This application claims priority from U.S. Provisional Patent Application No. 61/234,570 filed Aug. 17, 2009, which is incorporated by reference in its entirety herein to the extent that there is no inconsistency with the present disclosure.

BACKGROUND OF THE INVENTION

This invention relates to a wellhead connection between two wellhead housing members. The invention also extends to a method of forming a wellhead connection between two wellhead housing members.

Drilling of oil or gas wells typically involves attaching a drilling stack blow out preventer (BOP) stack to a conductor pipe, surface casing or other wellhead component on a temporary basis. Quick connection and break up of the drilling stack is desirable. Known wellhead connections to surface casings or conductor pipes do not readily accommodate this type of drilling stack attachment, see for example the following exemplary patents—U.S. Pat. No. 4,304,424 to Hanson, U.S. Pat. No. 4,239,266 to Mynhier, U.S. Pat. No. 4,936,382 to Thomas, U.S. Pat. No. 5,299,644 to Ekert, U.S. Pat. No. 5,332,043 to Ferguson, and U.S. Pat. No. 6,834,718 to Webster. There is still a need for a wellhead connection to a conductor pipe, surface casing or other wellhead component which will accommodate a drilling stack and which will also allow for quick makeup and disassembly after drilling.

Flanged drilling spools are often used within a drilling BOP stack, however, considerable time and equipment are needed to connect and disassemble. A wellhead spool adapted for quick makeup and disassembly would be useful for drilling and other wellhead applications.

SUMMARY OF THE INVENTION

The present invention provides a pressure-containing wellhead connection, and a method of forming a wellhead connection, which can be quickly and easily connected and disassembled at a wellhead.

In one broad aspect, a method is provided for forming a wellhead connection. The method includes:

i. providing a first housing member and a second housing member, each being adapted to be connected together in seated relationship with the first housing member partly within the second housing member, and forming an annulus between the housing members in an area of overlap, and being adapted to form a seal to a cylindrical inner bore when connected together and so as to provide a top connector and a bottom connector for wellhead equipment located above or below, the first housing member being formed with a circumferential groove in its outer periphery in the area of overlap;

ii. providing a radially expandable and contractable latch ring formed from a plurality of latch ring segments and positioned within the annulus so as to be adjacent the circumferential groove;

iii. maintaining the latch ring in an expanded position out of contact with the circumferential groove with radial actuators extending through the second housing member into contact with latch ring segments;

iv. landing the first housing member in the second housing member and optionally forming a seal to the inner bore;

v. moving the latch ring with the radial actuators into a radially contracted position in contact with the circumferential groove; and vi. locking the latch ring in the contracted position.

In one embodiment, the wellhead connection includes first and second housing members, each adapted to be connected together in seated relationship with the first housing partly within the second housing and forming an annulus between the housings in an area of overlap. The housings may be adapted to form a seal to a cylindrical inner bore (inner bore seal) when connected together. The housings provide a top connector and a bottom connector for connecting to wellhead equipment to be located above and below. The first housing is formed with a circumferential groove in its outer periphery in the area of overlap. A radially expandable and contractable latch ring is formed from a plurality of latch ring segments, the latch ring being held within the annulus so as to be adjacent the circumferential groove. Radial actuators extend through the second housing into contact with the latch ring segments to move the latch ring segments between a contracted position with the latch ring in contact with the circumferential groove, and an expanded position, with the latch ring out of contact with the circumferential groove. An annular retaining ring may be adapted to be positioned in the annulus in contact with the latch ring to lock the latch ring in the contracted position.

In another embodiment, a wellhead connection is provided which includes a generally cylindrical upper housing member having an upper portion and a lower portion and forming a cylindrical inner bore between the upper and lower portions. The upper portion forms a top connector being adapted to make a pressure-containing connection to wellhead equipment to be located thereabove. The lower portion also forms a sealing surface to form an inner bore seal. A circumferential ring groove is formed in an outer periphery of the upper housing member outside the sealing surface. A generally cylindrical lower housing member is provided with a lower end portion forming a bottom connector to connect to a wellhead member to be located therebelow. The lower end portion is adapted to seat the lower portion of the upper housing member in an area of overlap so as to form a continuous inner bore with the cylindrical inner bore of the upper housing or with an inner bore of the wellhead member. The lower housing member is also adapted to form an annular counterbore above the sealing surface, the counterbore forming an annulus to the outer periphery of the upper housing and being threaded at an upper end. The lower housing also forms threaded radial ports extending to the annulus for alignment with the circumferential ring groove. A radially expandable and contractable latch ring formed in a plurality of latch ring segments is adapted to be positioned in the annulus for radial movement between a contracted position locked in the circumferential ring groove, and an expanded position within the annulus. Each latch ring segment is formed with an outwardly opening locking slot. Each of a plurality of threaded radial bolts is adapted to be threaded into one of the radial ports. Each of the radial bolts has a locking end adapted to be received in locking relationship within the locking slot of a latch segment, whereby threaded movement of the radial bolts expands and contracts the latch ring segments. An annular retaining ring is adapted to be retained in the counterbore to lock the latch ring in the contracted position.

In yet a further embodiment, a wellhead connection is provided which includes a generally cylindrical upper housing member forming a cylindrical inner bore between its upper and lower portions. The upper portion forms a top connector adapted to make a pressure-containing connection to wellhead equipment to be located thereabove. The lower portion forms a sealing surface to form an inner bore seal, and a circumferential ring groove being formed in an outer periphery of the upper housing member outside the sealing surface. A generally cylindrical lower housing member has a lower end portion forming a bottom connector adapted to connect to a wellhead member to be located therebelow. The lower housing member is adapted to seat the lower portion of the upper housing member in an area of overlap so as to form an annulus between the upper and lower housing members in the area of overlap above the sealing surface and so as to form a continuous inner bore with an inner bore of the wellhead member. The lower housing is formed with a plurality of threaded radial ports extending to the annulus for alignment with the circumferential ring groove. A radially expandable and contractable latch ring formed in a plurality of latch ring segments is adapted to be positioned in the annulus for radial movement between a contracted position locked in the circumferential ring groove, and an expanded position within the annulus. Each latch ring segment is formed with an outwardly opening locking slot. Threaded radial bolts are provided, each being adapted to be threaded into one of the radial ports, and each having a locking end adapted to be received in locking relationship within the locking slot of a segment, whereby threaded movement of the radial bolts expands and contracts the latch ring segments. In this manner, after the upper and lower housing members are connected, the latch ring may be locked in the contracted position by tightening the bottom connector, such as a threaded connection, between the lower housing member and the casing head.

BRIEF DESCRIPTION OF THE DRAWINGS

FIG. 1 is an side sectional view of the components of the wellhead connection, showing the upper and lower housing members connected together with a segmented latch ring in a contracted position, radial bolts extending to slots in the latch ring, and a threaded retaining ring to apply downward force to lock the latch ring and to energize the inner bore seal.

FIG. 2 is a top perspective view of the wellhead connection of FIG. 1.

FIG. 3 is a sectional view taken along line B-B of FIG. 1.

FIG. 4 is a top perspective view of the segmented latch ring.

FIG. 5 is a perspective view of a radial bolt.

FIG. 6 is a side view of a radial bolt.

DETAILED DESCRIPTION OF THE INVENTION

Figure 7:
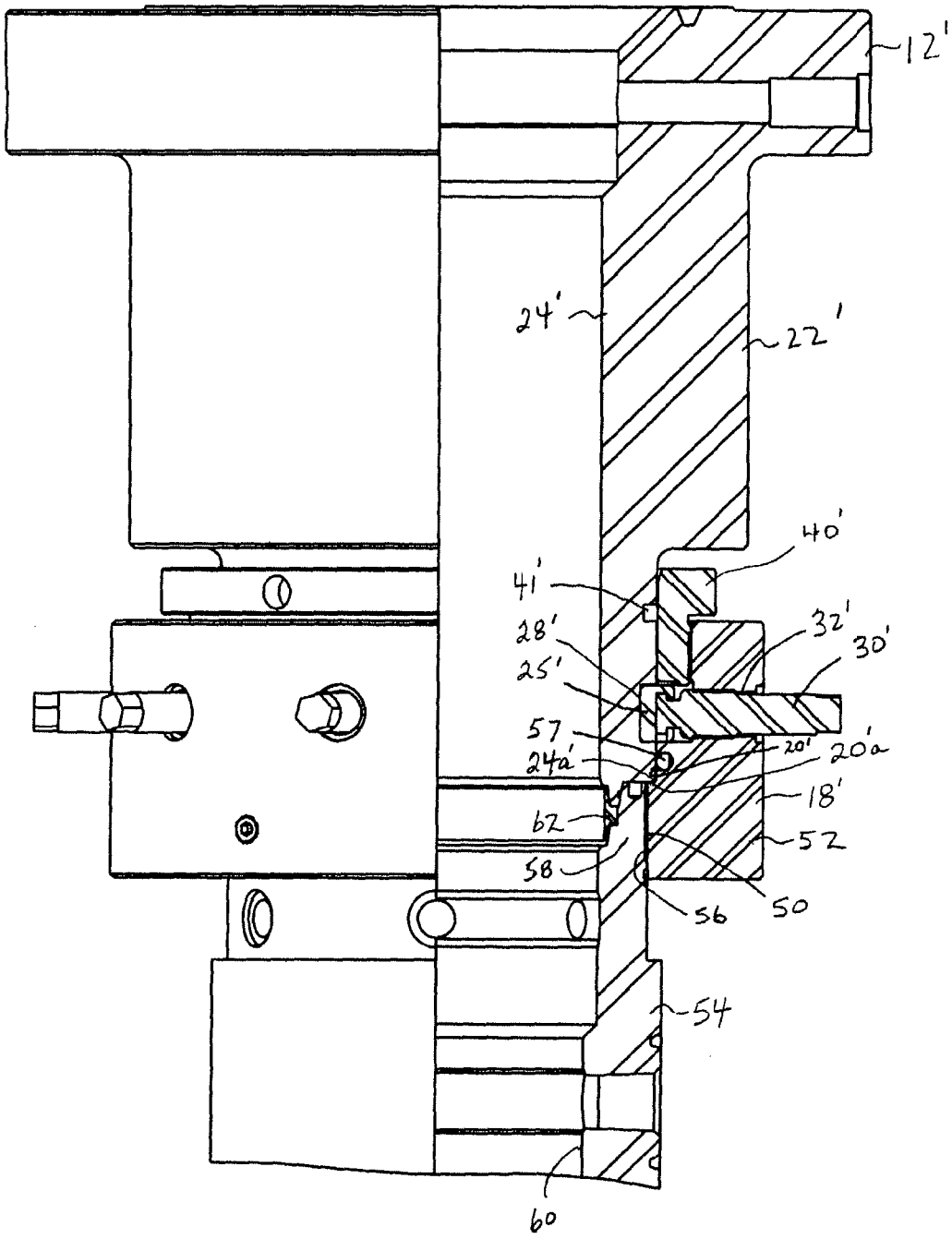
FIG. 7 is a partial sectional view of a second exemplary embodiment of the wellhead connection, in which the upper housing and lower housings are connected together with a segmented latch ring, as in the first embodiment, but wherein the lower housing includes a threaded connection at its lower end to a casing head, threaded at its outer surface. The casing head and upper housing are sealed together at the inner bore with seal, shown as a metal seal.
Figure 8:
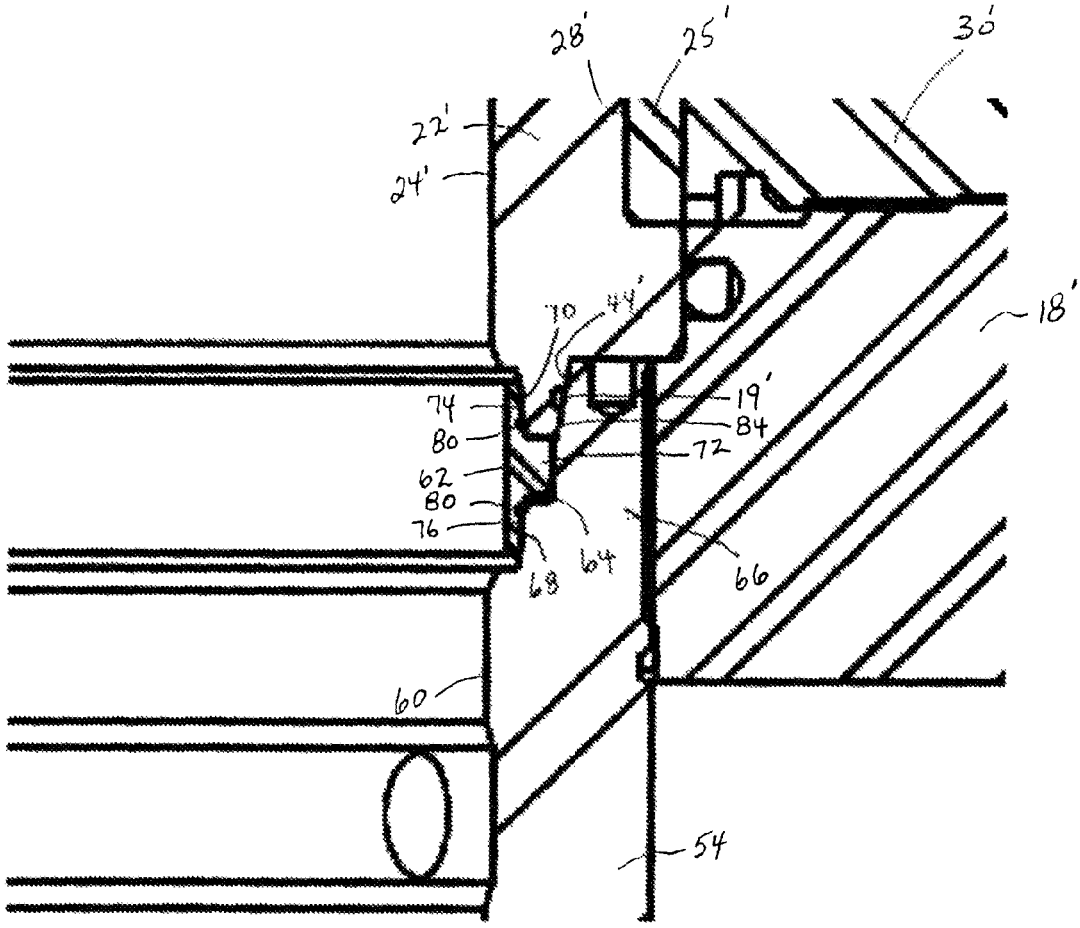
FIG. 8 is an enlarged sectional view of the inner bore seal area of FIG. 7.

A split spool wellhead connection 10 such as used for drilling is illustrated in FIGS. 1-6, but the invention has broader application. FIGS. 7 and 8 show a second exemplary embodiment of a wellhead connection with a threaded connection to a casing head located therebelow.

In FIGS. 1-6, the wellhead connection 10 is shown to include:

- Top and bottom flanged connections 12, 14 (alternate top and bottom connectors may include threaded, welded or hub connectors);
- Connection of upper and lower housings 22, 18 between flanges 12, 14 that can be quickly connected and disconnected as described more fully below; and
- Optional side outlets 16.

In the first embodiment of FIGS. 1-6, the wellhead connection 10 for quick make up and breaking apart, provides the following:

- a lower housing 18 having a profiled inner bore 20 providing inwardly extending seat 20*a* above a cylindrical inner bore 21 at its lower end portion;
- an upper housing 22 having a cylindrical inner bore 24 (which may be continuous with the bore 21 of the lower housing 18), which has a landing shoulder 24*a* to seat on seat 20*a* within the profiled inner bore 20 of the lower housing 18 in an area of overlap, and which engages lower housing 18 to affect a seal 19 (inner bore seal) when seated in the lower housing 18;
- a radially expandable and contractable latch ring 25 formed in a plurality of latch ring segments 25*a*, each segment 25*a* being formed with an outwardly opening locking slot 26 (shown for example as a T-shaped, but which may take other configurations) such that the latch ring 25, in its contracted position, engages a similarly shaped circumferential ring groove 28 formed on the outer peripheral surface of the upper housing 22 in the area of overlap between the upper and lower housings 18, 22, preferably above landing shoulder 24*a*, to lock the latch ring 25 into place, and segments 25*a* each having top and bottom surfaces which are flat and parallel (for example generally cylindrical in cross section, although other configurations may be used);
- a plurality of radial bolts 30 threaded into threaded radial ports 32 formed in the lower housing 18 to engage the segments 25*a* and to move the segments 25*a*, and thus the latch ring 25 between its expanded and contracted positions (example T-shaped locking ends 34 on radial bolts 30 to lock into T-shaped locking slots 26 and having threaded stem portions 33);
- a counterbore 36 formed in the profiled inner bore 20 of the lower housing 18, having base 37 to align radial ports 32, radial bolts 30 and latch ring 25 with the circumferential ring groove 28, the counterbore 36 forming an annulus A to the outer peripheral surface of the upper housing 22 and preferably having threads 38 formed at its upper end; and
- a retaining ring 40, preferably threaded, to be retained in the annulus A, such as by threading to the threads 38 of the counterbore 36, and to retain the segments 25*a* of the latch ring 25, to lock the housings 18, 22 together, and to apply a downward force on the latch ring 25, and thus on the upper housing 22, in order to lock the latch ring and optionally to energize the inner bore seal 19.

In a preferred embodiment, the well connection 10 may be used within a drilling BOP stack. The split spool 10, formed with upper and lower housings 22, 18, allows one to quickly break the drilling stack into multiple pieces. Small hand tools (ex. sockets and crescent wrench on ends of radial bolts 30, and turning rods in horizontal apertures 42 in retaining ring 40) are all that is required to makeup and break the connection. The sealing arrangement is set up so that the axial force to energize the inner bore seal 19 located between the housings 18, 22 is small. O-ring seals 41 between the retaining ring 40 and the upper and lower housings 22, 18 may be included, although these seals may not need to be pressure seals. The inner bore seal 19 may take the form of an elastomeric seal, such as an O-ring seal, or may take the form of a metal seal ring. Exemplary metal seals suitable for this application are shown in U.S. Pat. No. 5,059,140 to Szymezak; U.S. Pat. No. 6,561,521 to Janoff et al.; and US Published Patent Application 2009/0266558 published Oct. 29, 2009 to Farquharson et al. The seal 19 may be placed on mating, tapered sealing surfaces 44, 45 of the upper and lower housings 18, 22 as shown in FIG. 1. However the seal 19 might be located differently, for instance as one or more circumferential O-rings between the housings 18, 22. Circumferential O-ring seals are exemplary of an inner bore seal which might be energized on landing the upper housing 22 in the lower housing 18.

Retaining ring 40 and latch ring segments 25*a* function to lock all components together. Other styles of latch rings might be used, for instance the locking slots might be differently shaped such as U-shaped. Similarly, alternate radial actuators for the latch ring might be used instead of the threaded radial bolts. However, the embodiment of FIGS. 1-6 is particularly advantageous since large forces are not required for the locking connection. The connected wellhead connection 10 may be formed with approximately the same height as a standard flanged drilling spool for the preferred drilling applications.

While the invention is illustrated with the upper housing 22 landed within the lower housing 18 and forming a continuous inner bore 24, 21 extending there through, it should be understood that the invention has broader applications. For instance, the housings could be reversed, and one or more of the housing members may function as a closed member such as a cap.

FIGS. 7 and 8 shows a second exemplary embodiment of the wellhead connection 10', where like components are labeled with the same reference numerals as for the first embodiment, but to which a prime is added after the numeral. In the second embodiment the upper housing and lower housings 22', 18' are connected together with a segmented latch ring 25', similar to the first embodiment. However, the lower housing 18' is modified to include a threaded bottom connection 50 at its lower end portion 52 to connect to a casing head 54. While other bottom connections might be used, the threaded connection has the advantage of allowing for quick make up and disassembly. For the threaded connection, the casing head 54 is threaded at an outer peripheral surface 56 at its upper portion 58. A seal, such as an O-ring 57 may be included between the upper and lower housings 22', 18', below the radial ports 32'. This seal 57 is not necessary in all applications, and may not need to be pressure-containing.

The cylindrical inner bore 24' of the upper housing 22' is continuous with the cylindrical inner bore 60 of the casing head 54. The inner bores 60, 24' of casing head 54 and upper housing 22' respectively are sealed, with an inner bore seal which is shown in FIGS. 7,8 to be a metal seal ring 62. However, in some applications the inner bore seal may have alternate embodiments, or may be formed as an elastomeric seal such as an O-ring seal between overlapping or tapered sealing surfaces between the upper housing 22' and the casing head 54.

The metal seal ring 62 shown in FIGS. 7, 8 is similar to that described in above-mentioned US published Patent Application US2009/0266558. Alternate metal seals such as shown in above-mentioned U.S. Pat. No. 5,039,140 and U.S. Pat. No. 6,561,521 may also be used. Other metal seals as known to those skilled in the art may also be substituted.

The detail of the metal seal at the inner bore is best shown in FIG. 8. The casing head 54 is formed with an annular groove 64 at an upper portion 66 of its cylindrical inner bore 60, and a tapered wall surface 68 located below the groove 64. The upper housing 22' is formed with a tapered wall surface 70 located at a lower portion of its cylindrical bore 24'. The metal seal ring 62 is formed with an outer annular rib 72 to be received in the annular groove 64 of the casing head 54. The metal seal ring 62 is formed with upper and lower tapered seal surfaces 74, 76 on its outer surface, above and below the rib 72. The tapered seal surfaces 74, 76 are formed as mating seal surfaces for the tapered wall surfaces 70, 68. Preferably the tapered seal surfaces 74, 76 are tapered to form an angle which is slightly larger than the taper angle on the tapered wall surfaces 70, 68 in order to form an interference fit. When the metal seal ring 62 is placed at an inner bore surface to bridge the connection of the casing head 54 and upper housing 22', the annular rib 72 is held within annular groove 64, and the tapered seal surfaces 74, 76 may form a metal seal to the tapered wall surfaces 70, 68 due to an interference fit. One or more circumferential relief grooves 80 may be formed on the tapered seal surfaces 74, 76 of the metal seal ring 62 to permit minor deflection of the tapered seal surfaces 74, 76 during installation, and to prevent deformation of the metal seal ring 62. Similar to the first embodiment, a further seal 19' may be formed on tapered surfaces 44', 84 of the upper housings 22' and the casing head 54, although this second back up inner bore seal may not be needed in many applications.

Once the upper housing 22', lower housing 18', and casing head 54 are connected together, the retaining ring 40' is tightened in the annulus A' between the housings 18', 22' to lock the latch ring, and optionally to energize the metal seal ring 62, through a downward force applied to the latch ring 25' and upper housing 22'.

As with the first embodiment, the upper and lower housings 18', 22' may be quickly disassembled. After disassembly, the threaded upper end of the casing head 54 is available for a quick threaded connection to an production wellhead, such as a tubing head, through a threaded connector such as is shown in US published Patent Application 2008/0185156, to Rodgers et al., published Aug. 7, 2008.

In yet a further embodiment, the wellhead connection may be formed similarly to that shown in FIGS. 7, 8, but the lower housing member being formed as an integral annular housing, without the upper portion of the counterbore, and without the separate retaining ring. In this embodiment, the annulus is formed at the bore of the lower housing to align with the circumferential groove of the upper housing member. The lower end portion of the lower housing may be formed with a threaded connection, as shown in FIG. 7 to thread to a casing head located therebelow, again as shown in FIG. 7. The upper housing and the casing head may form a continuous inner bore, and an inner bore seal as described above for FIG. 7. However, the sequence of connection and seal energizing may be modified. The lower housing may be threaded to the casing head, the latch ring may be located in the annulus, and upper housing may then be lowered in place. The latch ring connection may be made as above-described. Once the upper and lower housings and the casing head are connected in this manner, final tightening of the threaded connection between the lower housing and the casing head pulls downwardly on the upper housing to lock the latch ring and optionally to energize the metal seal ring. As with the above embodiments, the metal seal ring may take other metal seal ring embodiments, and may be replaced with other types of seals such as an elastomeric seal. Similarly, the metal or elastomeric inner bore seal may be located differently, as mentioned above.

In still further embodiments, the wellhead connection may be configured similar to the embodiments shown in FIG. 1 or 7, but the retaining ring may be modified to accept vertical threaded members, such as cap screws, to extend through threaded ports in the retaining ring, to contact the latch ring and lock it in a contracted position, and optionally to provide the downward force to energize the inner bore seal.

As used herein and in the claims, the word "comprising" is used in its non limiting sense to mean that items following the word in the sentence are included and that items not specifically mentioned are not excluded. The use of the indefinite article "a" in the claims before an element means that one of the elements is specified, but does not specifically exclude others of the elements being present, unless the context clearly requires that there be one and only one of the elements. For example, the term "a seal" as used herein and in the claims may include multiple seals.

All references mentioned in this specification are indicative of the level of skill in the art of this invention. All references are herein incorporated by reference in their entirety to the same extent as if each reference was specifically and individually indicated to be incorporated by reference. However, if any inconsistency arises between a cited reference and the present disclosure, the present disclosure takes precedence. Some references provided herein are incorporated by reference herein to provide details concerning the state of the art prior to the filing of this application, other references may be cited to provide additional or alternative device elements, additional or alternative materials, additional or alternative methods of analysis or application of the invention.

The terms and expressions used are, unless otherwise defined herein, used as terms of description and not limitation. There is no intention, in using such terms and expressions, of excluding equivalents of the features illustrated and described, it being recognized that the scope of the invention is defined and limited only by the claims which follow. Although the description herein contains many specifics, these should not be construed as limiting the scope of the invention, but as merely providing illustrations of some of the embodiments of the invention.

One of ordinary skill in the art will appreciate that elements and materials other than those specifically exemplified can be employed in the practice of the invention without resort to undue experimentation. All art-known functional equivalents, of any such elements and materials are intended to be included in this invention. The invention illustratively described herein suitably may be practiced in the absence of any element or elements, limitation or limitations which is not specifically disclosed herein.

We claim:

1. A method of forming a wellhead connection comprising:

providing a first housing member and a second housing member, each being adapted to be connected together in seated relationship with the first housing member partly within the second housing member, and forming an annulus between the housing members in an area of overlap, and being adapted to form a seal to a cylindrical inner bore when connected together and so as to provide a top connector and a bottom connector for wellhead equipment located above or below, the first housing member being formed with a circumferential groove in its outer periphery in the area of overlap;

providing a radially expandable and contractable latch ring formed from a plurality of latch ring segments and positioned within the annulus so as to be adjacent the circumferential groove;

maintaining the latch ring in an expanded position out of contact with the circumferential groove with radial actuators extending through the second housing member into contact with latch ring segments;

landing the first housing member in the second housing member;

moving the latch ring with the radial actuators into a radially contracted position in contact with the circumferential groove; and locking the latch ring in the contracted position with an annular retainer ring adapted to be positioned in the annulus.

2. The method of claim 1, wherein the latch ring is locked in place with a downward force applied on the latch ring by the annular retainer ring.

3. The method of claim 2, wherein the first housing member is an upper housing member, the second housing member is a lower housing member, and the downward force is applied by the annular retaining ring positioned in contact with the latch ring in the annulus formed by the lower housing member.

4. The method of claim 3, wherein the annular retaining ring is threaded into the annulus to apply the downward force.

5. The method of claim 4, wherein:

the lower housing member and the upper housing member together form a continuous inner bore extending there through;

the upper housing member has a lower portion which forms a sealing surface to mate with a sealing surface of the lower housing member to form an inner bore seal between the upper and lower housing members.

6. The method of claim 5, wherein the sealing surface of the upper housing member and the sealing surface of the lower housing member are mating tapered sealing surfaces, and wherein the downward force applied by the retaining ring energizes the inner bore seal.

7. The method of claim 3, wherein:

the bottom connector is provided on the lower housing member and is adapted to connect to a casing head located below the lower housing member such that the upper housing member forms a continuous inner bore with the casing head;

an inner bore seal is formed between the upper housing member and the casing head; and the latch ring is locked in place with the downward force applied on the latch ring.

8. The method of claim 7, wherein the annular retaining ring is threaded into the annulus to apply the downward force.

9. The method of claim 3, wherein;

the bottom connector is provided on the lower housing member and is adapted to connect to a casing head located below the lower housing member such that the upper housing member forms a continuous inner bore with the casing head;

an inner bore seal is formed between the upper housing member and the casing head; and after the upper and lower housing members are connected, the latch ring is locked in the contracted position by tightening the bottom connector between the lower housing member and the casing head.

10. The method of claim 9, wherein the bottom connector is a threaded connection to a threaded connector on the casing head.

11. The method of claim 10, wherein the inner bore seal is formed with a metal seal ring at the surface of the inner bore bridging the upper housing member and the casing head, and wherein tightening the bottom connector energizes the inner bore seal.

12. A wellhead connection comprising:

a first housing member and a second housing member, each being adapted to be connected together in seated relationship with the first housing member partly within the second housing member and forming an annulus between the housing members in an area of overlap, and being adapted to form a seal to a cylindrical inner bore when connected together and so as to provide a top connector and a bottom connector for connecting to wellhead equipment to be located above and below, the first housing member being formed with a circumferential groove in its outer periphery in the area of overlap;

a radially expandable and contractable latch ring formed from a plurality of latch ring segments, the latch ring being held within the annulus so as to be adjacent the circumferential groove;

radial actuators extending through the second housing member into contact with the latch ring segments to move the latch ring segments between a contracted position with the latch ring in contact with the circumferential groove, and an expanded position, with the latch ring out of contact with the circumferential groove; and an annular retaining ring adapted to be positioned in the annulus in contact with the latch ring to lock the latch ring in the contracted position.

13. A wellhead connection comprising:

a generally cylindrical upper housing member having an upper portion and a lower portion and forming a cylindrical inner bore between the upper and lower portions, the upper portion forming a top connector being adapted to make a pressure-containing connection to wellhead equipment to be located thereabove, the lower portion forming a sealing surface to form an inner bore seal, and a circumferential ring groove being formed in an outer periphery of the upper housing member outside the sealing surface;

a generally cylindrical lower housing member having an upper end portion and a lower end portion, the lower end portion forming a bottom connector to connect to a wellhead member to be located therebelow, the lower end portion being adapted to seat the lower portion of the upper housing member in an area of overlap so as to form a continuous inner bore with the cylindrical inner bore of the upper housing or with an inner bore of the wellhead member, the lower housing member being adapted to form an annular counterbore between its upper and lower end portions above the sealing surface, the counterbore forming an annulus to the outer periphery of the upper housing and being threaded at an upper end, and the lower housing being formed with a plurality of threaded radial ports extending to the annulus for alignment with the circumferential ring groove;

a radially expandable and contractable latch ring formed in a plurality of latch ring segments adapted to be positioned in the annulus for radial movement between a contracted position locked in the circumferential ring groove, and an expanded position within the annulus, each latch ring segment being formed with an outwardly opening locking slot;

a plurality of threaded radial bolts, each of the radial bolts being adapted to be threaded into one of the radial ports and each of the radial bolts having a locking end adapted to be received in locking relationship within the locking slot of a latch ring segment, whereby threaded movement of the radial bolts expands and contracts the latch ring segments; and an annular retaining ring adapted to be retained in the counterbore to lock the latch ring in the contracted position.

14. The wellhead connection of claim 13, which further comprises one or more of the following:

the retaining ring being adapted to seal to each of the upper and lower housing members;

the locking slots in the latch ring segments and the locking ends of the radial bolts being T-shaped;

the top connector forming a top flange connection to the wellhead equipment to be located thereabove;

the bottom connector forming a bottom flange connection or a bottom threaded connection to the wellhead member located therebelow;

the upper housing member forming one or more outlets between its upper and lower portions above the lower housing member;

the retaining ring being formed with opposed horizontal apertures at an upper end to accept turning members to assist with threading; and the radial bolts being formed with outer connecting ends adapted for socket or crescent wrench attachment.

15. The wellhead connection of claim 14, wherein:

the lower housing member and the upper housing member are adapted to form a continuous inner bore when seated together; and the sealing surface of the upper housing is tapered to mate with a tapered sealing surface of the lower housing member to form an inner bore seal between the upper and lower housing members.

16. The wellhead connection of claim 15, wherein the inner bore seal is an elastomeric seal.

17. The wellhead connection of claim 15, wherein the inner bore seal is a metal seal.

18. The wellhead connection of claim 13, wherein:

the bottom connector of the lower housing member is adapted to connect to a casing head located therebelow in a manner such that the upper housing member forms a continuous inner bore with the casing head; and the inner bore seal is formed between the upper housing member and the casing head.

19. The wellhead connection of claim 18, wherein the bottom connector of the lower housing member forms a threaded connection to the casing head.

20. The wellhead connection of claim 19, wherein:

the inner bore seal is formed with a metal seal ring configured to form the inner bore seal at a surface of the inner bore between the upper housing member and the casing head, and the annular retaining ring is adapted to be threaded into the counterbore to energize the inner bore seal.

21. A wellhead connection comprising:

a generally cylindrical upper housing member having an upper portion and a lower portion and forming a cylindrical inner bore between the upper and lower portions, the upper portion forming a top connector adapted to make a pressure-containing connection to wellhead equipment to be located thereabove, the lower portion forming a sealing surface to form an inner bore seal, and a circumferential ring groove being formed in an outer periphery of the upper housing member outside the sealing surface;

a generally cylindrical lower housing member having an upper end portion and a lower end portion, the lower end portion forming a bottom connector adapted to connect to a wellhead member to be located therebelow, the lower housing member being adapted to seat the lower portion of the upper housing member in an area of overlap so as to form an annulus between the upper and lower housing members in the area of overlap above the sealing surface and so as to form a continuous inner bore with an inner bore of the wellhead member, and the lower housing being formed with a plurality of threaded radial ports extending to the annulus for alignment with the circumferential ring groove;

a radially expandable and contractable latch ring formed in a plurality of latch ring segments adapted to be positioned in the annulus for radial movement between a contracted position locked in the circumferential ring groove, and an expanded position within the annulus, each latch ring segment being formed with an outwardly opening locking slot; and a plurality of threaded radial bolts, each of the radial bolts being adapted to be threaded into one of the radial ports and each of the radial bolts having a locking end adapted to be received in locking relationship within the locking slot of a segment, whereby threaded movement of the radial bolts expands and contracts the latch ring segments, such that, after the upper and lower housing members are connected, the latch ring is locked in the contracted position by tightening the bottom connector between the lower housing member and the wellhead member located therebelow.

22. The wellhead connection of claim 21, wherein the wellhead member is a casing head, and wherein the bottom connector is a threaded connection to a threaded connector on the casing head.

23. The wellhead connection of claim 22, wherein the inner bore seal is formed with a metal seal ring at the surface of the inner bore between the upper housing member and the casing head, and wherein tightening the bottom connector between the lower housing and the casing head energizes the inner bore seal.

* * * * *